US006817379B2

(12) United States Patent
Perla

(10) Patent No.: US 6,817,379 B2
(45) Date of Patent: Nov. 16, 2004

(54) WATER DELIVERY DEVICE AND METHOD OF FORMING SAME

(76) Inventor: Frank Perla, 1623 W. 2100 North, Helper, UT (US) 84526

( * ) Notice: Subject to any disclaimer, the term of this patent is extended or adjusted under 35 U.S.C. 154(b) by 31 days.

(21) Appl. No.: 10/260,941

(22) Filed: Sep. 30, 2002

(65) Prior Publication Data

US 2003/0062088 A1 Apr. 3, 2003

Related U.S. Application Data

(60) Provisional application No. 60/326,865, filed on Oct. 2, 2001.

(51) Int. Cl.[7] ..... E03C 1/04
(52) U.S. Cl. ..... 137/801; 4/678; 29/890.141
(58) Field of Search ..... 4/678; 29/890.141; 137/801

(56) References Cited

U.S. PATENT DOCUMENTS 20,395 A * 5/1858 Wood ..... 29/890.141
2,219,471 A * 10/1940 Davis ..... 137/375
2,367,809 A * 1/1945 Stein et al. ..... 137/801
4,884,596 A * 12/1989 Byers et al. ..... 137/801
5,579,808 A * 12/1996 Mikol et al. ..... 137/801
5,579,823 A 12/1996 Mikol et al.

* cited by examiner

*Primary Examiner*—Gerald A. Michalsky
(74) *Attorney, Agent, or Firm*—Morriss O'Bryant Compagni, P.C.

(57) ABSTRACT

A plumbing part in the form of a water delivery device is comprised of a protective liner through which potable water can flow. The protective liner is in the form of one or more lengths of stainless steel tubing and is encased in a casting of a desired material, such as bronze or brass. Fittings required to attach the water delivery device to sinks, bathtubs or other water sources and to allow for insertion of various aerators and other flow devices are also encased in the casting. The various fittings are pre-assembled to the liner prior to casting to ensure a water-tight seal between the liner and the fittings prior to casting.

34 Claims, 14 Drawing Sheets

WATER DELIVERY DEVICE AND METHOD OF FORMING SAME

CROSS-REFERENCE TO RELATED APPLICATIONS

This application claims priority to U.S. Provisional patent application Ser. No. 60/326,865 filed on Oct. 2, 2001.

BACKGROUND

1. Field of the Invention

This invention relates generally to faucets and other water delivery devices, and more particularly to faucets and other water delivery devices in which a material is cast around a protective liner in order to form a water delivery device that meets current safety standards including, but not limited to the National Sanitation Foundation International (NSF) and the Canadian Standards Association (CSA).

2. Description of the Prior Art

In order to meet NSF an CSA or other state, national or international safety standards for water delivery devices, many faucets and other water delivery devices presently in the art are formed primarily from low-lead brass alloys and then plated with either chrome, brass, PDM or nickel type plating to achieve their desired finish. Other water delivery devices utilizes plastic coverings with snap-on liners with the covering provided to conceal the liner. Such liners are typically lined with copper tubing or molded plastic tubes. The liners and coverings of such plastic faucets are separately formed and assembled after individual formation of the various components. For example, the covering may include a top decorative portion for housing the liner. A separate bottom portion is then attached to the decorative portion, as by snapping or fastening, to enclose the liner within the device.

In many applications it would be desirable for water delivery devices to be formed from a stainless steel core or liner with other materials such as bronze, brass, ceramics, or plastics providing an exterior decorative shell. Stainless steel has been identified by most current safety standards as the preferred material for drinking water delivery devices. Unlike other materials commonly used in water delivery devices, stainless steel does not leach lead, arsenic or other potentially harmful or damaging particles into the water as the water flows through a stainless steel tube. Stainless steel, however, is very difficult to work with and form into desired shapes for decorative purposes and is more expensive than traditional faucet making materials. As such, the commercial use of stainless steel in decorative water delivery devices has been non-existent.

While stainless steel is the preferred material, it would also be desirable to be able to cast copper tubing or other lining materials directly into decorative, functional or other coverings formed from copper, bronze, pewter, ceramics, plastics or other materials. For example, it would be advantageous in the art to form a bronze water delivery with a stainless steel liner that prevents leaching of the bronze materials into the water. Thus, it would be advantageous to allow the flexibility of design by using moldable or castable materials to form the decorative portions of the water delivery device while lining the inside of the water delivery device to prevent leaching.

One such plumbing part that has been disclosed in the prior art is shown in U.S. Pat. No. 5,579,823 (the "'823 patent") to Erwin F. Mikol and Andrew G. Pawlyszyn, now assigned to Moen Incorporated of North Olmsted, Ohio. The '823 patent discloses a plumbing part made from a permanent core and a body cast around the core. The core is formed of a material which meets the requirements as to the permitted leachability of lead and/or other undesirable materials from the core into water flowing through it. The core material has a melting point preferably at least 200 degrees F. above that of the cast body. The core also has a coefficient of expansion which is equal to or least than that of the material forming the cast body.

The core of the '823 patent is formed of #304 stainless steel and includes an upper stamping and a lower stamping. These two elements have outwardly extending flanges that are joining by welding, crimping or folding to thus join the upper and lower waterways in to a single unitary core. Thus, the core is formed from at least two separate parts that must be joined together to form the waterways of the desired core.

Thus, it would be advantageous to provide a plumbing part forming a water delivery device that utilizes a core that eliminates the concern of leaching of lead or other undesirable material from the water delivery device to the water, the core being formed from a length of tubing.

It would be a further advantage to provide a plumbing part forming a water delivery device which is relatively easy to manufacture and does not require any significant separate manufacture of the core prior to formation of the plumbing part.

It would be yet a further advantage of the present invention to provide a casting process which prevents inadvertent melting of the core during the formation process.

It would be still another advantage to provide a casting process which allows for use of materials with different coefficients of expansion without adversely effecting the finished plumbing part.

SUMMARY OF THE INVENTION

Accordingly, a plumbing part in the form of a water delivery device, in accordance with the principles of the present invention, is comprised of a protective liner through which potable water can flow. The protective liner is encased in a casting of a desired material, such as bronze or brass. Fittings required to attach the water delivery device to sinks, bathtubs or other water sources and to allow for insertion of various aerators and other flow devices are also encased in the casting. The various fittings are pre-assembled to the liner prior to casting to ensure a water-tight seal between the liner and the fittings prior to casting.

One method of forming a plumbing part in the form of a water delivery device in accordance with the present invention comprises providing a pattern of the desired exterior shape of the water delivery device. The pattern may be formed from an easily moldable material such as wood or plastic or some other formable material. The pattern is formed by forming a complete full-scale model of the desired exterior shape of the plumbing part. The model is then cut or otherwise divided in half along a longitudinal axis of the model. The pattern is formed by placing and attaching each half of the model inside a box-like structure. The pattern is then filled with casting sand. The sand is packed firmly around the pattern. Once the pattern is packed tightly with sand, the pattern and the casting sand are separated leaving a sand mold of one half of the water delivery device. The other half of the mold for the water delivery device is essentially a mirror image of the first and is formed by packing casting sand around the pattern for the second half in the same manner. Of course, those of skill in the art will appreciate that other methods of casting and casting materials may also be employed in accordance with the principles of the present invention. When combined, the two mold halves form a mold cavity in the shape of the entire model of the water delivery of the present invention.

The protective liner is formed into a shape that will position the liner generally along a central portion of the mold cavity of the mold. In one embodiment, the liner consists of a stainless steel tube, but it can also be made from other materials known in the art. The tube is thus bent into a particular shape matching the general curvature of the longitudinal length of the water deliver device so as to reside generally long a center-line of the water delivery device.

Because heat generated during casting may have an adverse effect on the liner, especially in areas where the casting material is to be relatively thick, a sand-like or other type of core material is applied to the exterior of the liner along its length where the casting material may pose a threat to the integrity of the liner. This is generally at the wider or more voluminous regions of the mold cavity. Thus, in order to maintain a relatively consistent casting thickness about the liner, the liner is packed or otherwise covered along certain portions thereof with a liner protection material (e.g., sand core). As such, a relatively regular annular space can be formed around the liner protection material along a complete length of the liner. It is noted that the liner protection material not only protects the liner from becoming damaged due to excessive heat during the casting process, but also reduces the amount of casting material needed to form the finished water delivery device in accordance with the principles of the present invention.

The annular space between the mold cavity and the liner protection material creates a space where the molten metal flows to form the exterior of the water delivery device and also defines the appropriate thickness of the casting portion of the water delivery device. The liner protection material helps to dissipate heat from the casting and prevents the heat from damaging the liner or otherwise allowing the casting material to melt holes in the liner. As previously discussed, the liner protection material also reduces the weight of the final casting and reduces the amount of casting material needed to complete the cast. It should be noted that, in some locations of the mold, the thickness of the casting material is thin enough that the liner itself can provide sufficient cooling during the casting process to prevent the casting material from melting or otherwise compromising the integrity of the liner. In such regions, the core material may not be necessary.

Such a core material, however, produces gas when exposed to the molten casting material. In order to help prevent such gases from escaping through the casting material resulting in holes blown through the side of the casting, a core vent is provided which is in fluid communication with the core material and the exterior of the mold. Such a core vent may be formed from such materials as braided metal, heat resistant fabrics, wax, perforated metal tubing, or other materials that can be placed in the mold and in fluid communication with the liner protection material to allow gases formed within the casting as a result of the heat of the casting material to flow into the core vent at points along its length and flow out of the mold to relieve gas pressure within the casting. In one embodiment, the core vent is formed from a braided cloth tube that is placed in the sand core. As gasses are generated by the core material, they naturally pass through the braided tube wall and into the interior of the core vent. By placing the interior passage of the core vent in communication with the outside of the mold, the gasses can flow out of the mold through a desired location in the casting rather than through the side of the casting producing an undesirable blow hole. In another embodiment, the core vent may be attached to a small piece of copper tubing that acts as a chimney.

The liner is placed in the casting mold in the mold cavity formed by the pattern of the water delivery device as previously discussed. The liner extends beyond both ends of the mold cavity in order to support the liner within the mold cavity. As desired for the type of water delivery device being formed, various fittings may be attached to the liner and thus placed in the mold. Such fittings may allow the finished water delivery device to be attached to a water source or other plumbing fixtures.

A flange is attached as by welding, soldering or other means of joining known in the art to a point proximate to the discharge opening of the liner.

In the situation where the fitting for attaching the inlet of the water delivery device is cast into the component, fixing both ends of the liner during a molten metal casting process may cause cracks in the casting as a result of the contraction of the casting during the cooling stages. That is, because the casting and liner will have different coefficients of thermal expansion due to their differences in material compositions and because the liner is significantly cooler than the molten casting material, the liner should be allowed to move relative to the casting metal as the casting metal contracts to prevent tears or damage to the casting material that may otherwise occur as a result of the shrinking of the casting material relative to the liner during the cooling process.

As such, a sleeve is attached to the inlet fitting as by welding or other means of attachment known in the art. The sleeve has an interior diameter that allows the liner to fit therein. After casting, as the casting cools and shrinks relative to the liner, the liner will protrude from the sleeve. The proximal or inlet end of the liner protruding from the exposed end of the sleeve can be cut and attached to the sleeve by welding, soldering or other means of joining known in the art which provides a water-tight seal between the sleeve and the liner.

Once all of the desired components are placed in the first half of the mold, the second half of the mold is fitted to the first half to effectively close the mold. Molten material is poured into the mold cavity to encase the stainless steel liner. Once the casting material has solidified, the mold is opened and the casting of the water delivery device is removed. The small molten metal resistant tube used to vent gases from the mold is twisted until loosened and then removed. Because the liner protection material turns into a particulate form after being exposed to the heat from the casting process, the core material can generally be shaken out through the hole left by the molten metal resistant tube. The excess liner at the outlet end of the water delivery device is cut off and a fitting is attached to the inlet of the liner. The outlet of the water delivery device is counterbored until the flange is reached. The opening created by the drill is then threaded as by tapping in order to allow an aerator to be attached.

Finally, the flashing formed between the mold halves is removed as by grinding or sanding and the exterior of the water delivery device is polished to the desired finish.

DETAILED DESCRIPTION

Often in various plumbing related situations, it is desirable to be able to create faucets or other water delivery devices out of materials such as cast bronze, brass, ceramics or plastics. In doing so, care must be taken to ensure that such faucets and/or water delivery devices meet current safety standards including, but not limited to, NSF and CSA guidelines. Such materials, however, may contain contaminants that can leach into potable water. One material that has been approved by the NSF is stainless steel which has been found to not leach any appreciable amounts of materials that are considered by the NSF to be unsafe for potable or drinking water. Because of the hardness of stainless steel, however, forming decorative faucets and the like from stainless steel alone is quite difficult. The present invention provides an apparatus and method for forming a plumbing fixture in the form of a decorative water delivery device and method of forming such a decorative water delivery device. The water delivery device utilizes a liner in the form of one or more lengths of stainless steel tubing that prevents materials contained in the decorative or cast portion of the water delivery device from leaching into water flowing through the device.

Figure 1:
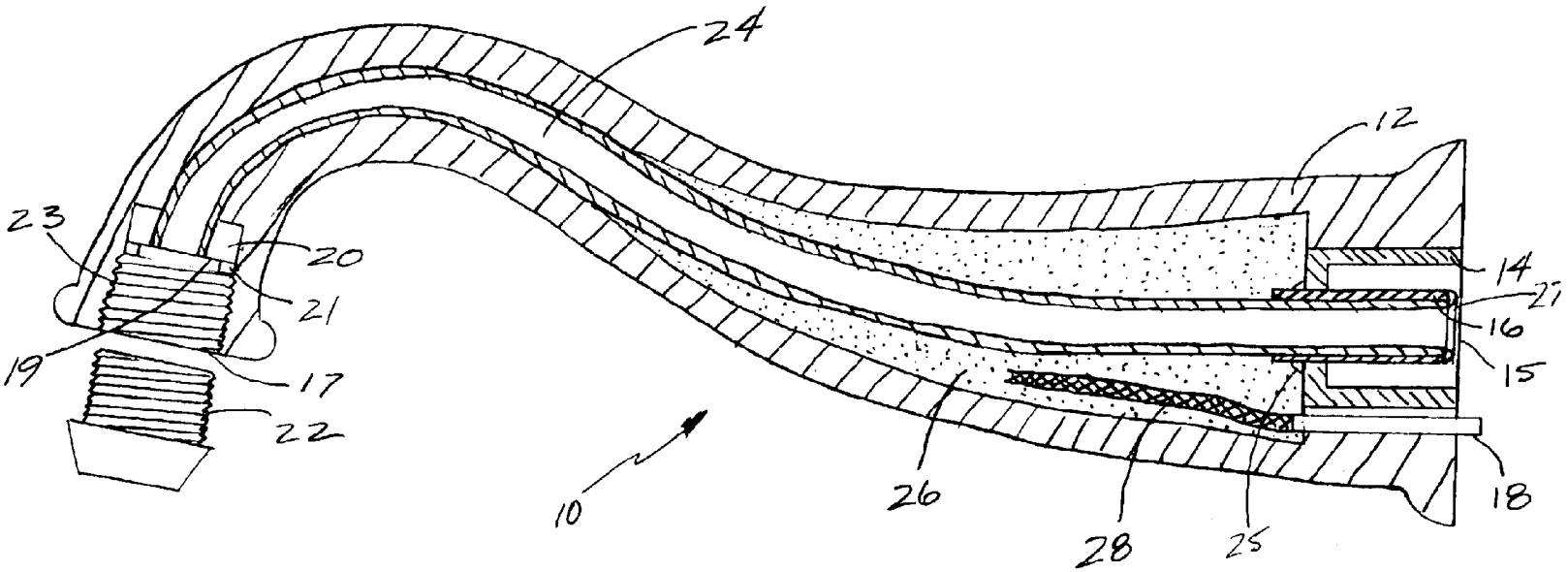
FIG. 1 is a cross-sectional side view of a first embodiment of a water delivery device in accordance with the principles of the present invention.

FIG. 1 illustrates a first embodiment of a plumbing fixture in the form of a water delivery device or faucet, generally indicated at 10, in accordance with the principles of the present invention. The faucet 10 is comprised of an outer bronze casting 12. The casting 12 provides a decorative outer exterior for the faucet while housing a protective liner 24. Thus, the casting 12 effectively forms a shell or housing around the liner 24 to provide the desired look and feel to the faucet while incorporating the safety of a liner which prevents leaching of undesirable materials in the casting material from entering into water flowing through the faucet 10. It should be noted, that the casting 12 may be formed from any desirable material, whether or not presently known in the art.

The faucet utilizes a protective liner 24 in the form of one or more lengths of tubing. The liner 24 is formed from stainless steel tubing or other tubing materials that provide a channel through which water can flow through the faucet 10 from its proximal end or inlet 15 to the distal end or outlet 17. The tubing 24 prevents contaminants in the casting materials from leaching into water that flows through the faucet 10. The protective liner 24 can be made of any material that meets the NSF requirements for clean drinking water. Since the NSF has approved of the use of stainless steel, the liner 24 may be made out of stainless steel.

The protective liner 24 has a stainless steel flange 20 welded or otherwise attached to the liner 24 proximate its distal end or outlet 17. The flange 20 provides a surface 19 for sealing with an aerator 22. A seal 21, such as a rubber washer may be used to seal the aerator to the flange 20. The flange 20 is essentially a cylindrically-shaped washer made of stainless steel or other suitable material that is sized to fit over the liner 24. Threads 23 formed on the inside of the outlet 17 of the casting 12 are configured to engage with external threads on the aerator 22. Thus, the aerator 22 is threadedly attached to the outlet end 17 of the water delivery device 10. It is also contemplated that external threads could be formed on the outlet 17 either through direct threading of the outlet or by insertion of an externally threaded fitting that engages the outlet and extends therefrom to form exposed external threads for attachment of an aerator thereto.

The inlet end 15 of the water delivery device 10 is provided with an internally threaded fitting 14 used to attach the water delivery device 10 to a water source, such as an externally threaded pipe or other plumbing fixture as desired. It is also contemplated that an externally threaded fitting may also be employed. The fitting 14 allows the water delivery device 10 to be attached to a pipe extending from a wall or other plumbing fixture for mounting. The fitting 14 is made of stainless steel or other appropriate material common in the art.

Because the outlet end 17 of the liner 24 is fixed upon casting to the outlet end 17 of the casting 12, fixing the inlet end 15 of the liner 24 to the fitting 14 will not allow the liner 24 to expand and/or the casting 12 to contract relative to the liner during the casting and cooling process without causing the liner 24 to be placed in a compressed state. As such, the forces exerted by the liner 24 against the casting as the casting cools, may adversely effecting the casting 12, such as causing fracturing of the casting at or more locations. In order to allow the liner 24 to move relative to the casting 12 as the casting cools, an expansion sleeve 16 is placed around the protective liner 24 and is attached to the fitting 14 as by welding or other means of attachment known in the art. Once the casting process is completed and the casting 12 has sufficiently cooled, the expansion sleeve 16 is welded or otherwise attached, as by crimping or clamping to the proximal end of the protective liner 24. The outer diameter of the sleeve 16 is sufficiently less than the inside diameter of the pipe or fixture to which the fitting 14 is attached so as to not interfere with such attachment. The sleeve 16, by not being fixedly secured until after the casting has sufficiently cooled, allows the liner 24 to change in length relative to the casting, or vise versa, until the casting 12 has cooled. Upon adequate cooling, the sleeve 16 is then fixedly attached to the liner 24 to form a water-tight seal thereinbetween. Any excess liner 24 material can then be trimmed to the desired length.

Casting bronze, other molten materials, plastics or ceramics around one or more segments of stainless steel tubing 24 presents several unique problems. For example, the heat of the molten material against the stainless steel liner 24 may be sufficient to actually melt one or more holes in the liner 24 during the casting process rendering the finished plumbing fixture non-compliant with NSF guidelines. If such holes are formed in the liner 24 during the manufacturing process, the liner 24 would not be adequately performing its primary function, that is providing a clean passageway for potable water from the inlet of the faucet 10 to the outlet. Melting of the liner 24 is of particular concern in areas of thicker portion of the casting 12. The mass of the molten material at such thicker portions tends to hold the heat at a higher temperature at the liner for a long enough period of time so as to melt the liner.

By placing a sand core material 26 around the liner 24 prior to casting in the more voluminous areas of the mold cavity, that is, along the thicker or wider portions of the casting 12, the sand core 26 provides a buffer or heat shield around the liner 24 at the points where the mass of the liner 24 itself is not sufficient to cool the molten material at its surface without compromising the integrity of the liner 24. Thus, the sand core 26 helps to absorb the heat of the molten material and protects the liner 24 during the casting process. Furthermore, the sand core 26 reduces the amount of bronze that would otherwise be needed to form the water delivery device making the part ultimately lighter and less expensive to manufacture.

Because the material used for such a sand core 26 includes various binders to allow molding of the core material around the liner 24, the sand core 26 will generate gases as the core material 26 is heated when contacted by the molten casting material 12. Unless such gases are provided with a path of escape from the casting 12, the gases will cause bubbles and or blow holes through the molten material potentially leaving holes in the exterior surface of the finished casting 12. In order to provide a vent for these gases, a core vent 28 is formed from a section of a core vent material such as a braided or woven material, wax or other suitable materials known in the art. The core vent 28 is placed within the sand core 26. The core vent 28 is attached to a small piece of tubing 18, such as copper or other heat tolerant tubing, which forms a chimney through which gases can flow through the casting 12 at the inlet end 15 at a point where the decorative element of the device will not be compromised. The copper tubing 18 allows the gases that are pulled off the core 26 to pass through the casting 12 and then through the mold. Once the casting process is complete, the hole left by the tubing 18 can be used to remove the sand core 26. That is, as the binder material contained in the sand core 26 is heated and generates the aforementioned gases, the sand core 26 transforms into a loose particulate sand that can be removed from the casting through the opening created by the core vent. Thus, such sand particles can simply be shaken from the casting 12 in order to remove them.

As previously discussed, the casting 12 contracts as the casting material transitions from a liquid molten state to a solid state and as the solid casting material further cools in the mold. Because the liner 24 is generally cooler than the casting material during the casting process and further due to the different coefficients of expansion of the two materials, the casting 12 will generally shrink in length more than the liner. Because it is desirable to rigidly fix the liner relative to the cast part in the finished plumbing part such that the cast part and the liner form a single component, the present invention provides a means of allowing the length of the liner to adjust itself to the length of the casting, that is, to shrink at its own rate relative to the casting without adversely effecting the casting and means for rigidly fixing the liner relative to the casting once the casting has hardened.

The liner is provided with a fitting 14 and expansion sleeve 16, with the expansion sleeve allowing shortening of the casting relative to the liner 24 during the cooling process. If the fitting 14 and sleeve 16 were fixed to the liner 24 during the casting process, the contraction of the casting as the casting cooled may cause cracks in the outer surface of the casting. Any such visible cracks would render the finished plumbing part defective and therefore not desirable for sale or purchase. The sleeve 16 allows the casting 12 to contract relative to the liner 24 during the casting process while providing an exposed member to which the liner can be attached after the casting process to seal the liner 24 to the fitting 14.

Thus, as illustrated, the sleeve 16 is welded to the fitting 14, which may have internal threads (not shown) for attachment as a conventional plumbing fixture. The weld 25 extends circumferentially around the outside surface of the sleeve 16 at a joint or point of contact between the back or distal end of the fitting 14 and the sleeve 16. As shown, the sleeve 16 may extend beyond the back side of the fitting 14 to allow for easy placement of the weld 25. By extending the weld 25 completely around the joint between the sleeve 16 and the fitting 14, a water-tight seal is formed.

During casting, the liner 24 extends beyond the proximal end 15 and is not welded with weld 27 to the proximal end of the sleeve 16. That is, as previously discussed, the sleeve 16 can move relative to the liner 24 during the casting process to allow for shrinkage of the casting 12 relative to the liner 24 as the casting 12 cools. Once the casting 12 has sufficiently cooled, however, the liner 24 is cut so as to be substantially flush with the proximal end of the sleeve 16. A weld bead 27 is then applied over the distal ends of the liner 24 and sleeve 16 so as to form a water-tight seal between the two. It is noted that because the welds 25 and 27 may be exposed to potable water as it flows into the plumbing fixture 10, the welds 25 and 27, as well as the sleeve 16 is formed from a material approved for drinking water, such as stainless steel.

Figure 2:
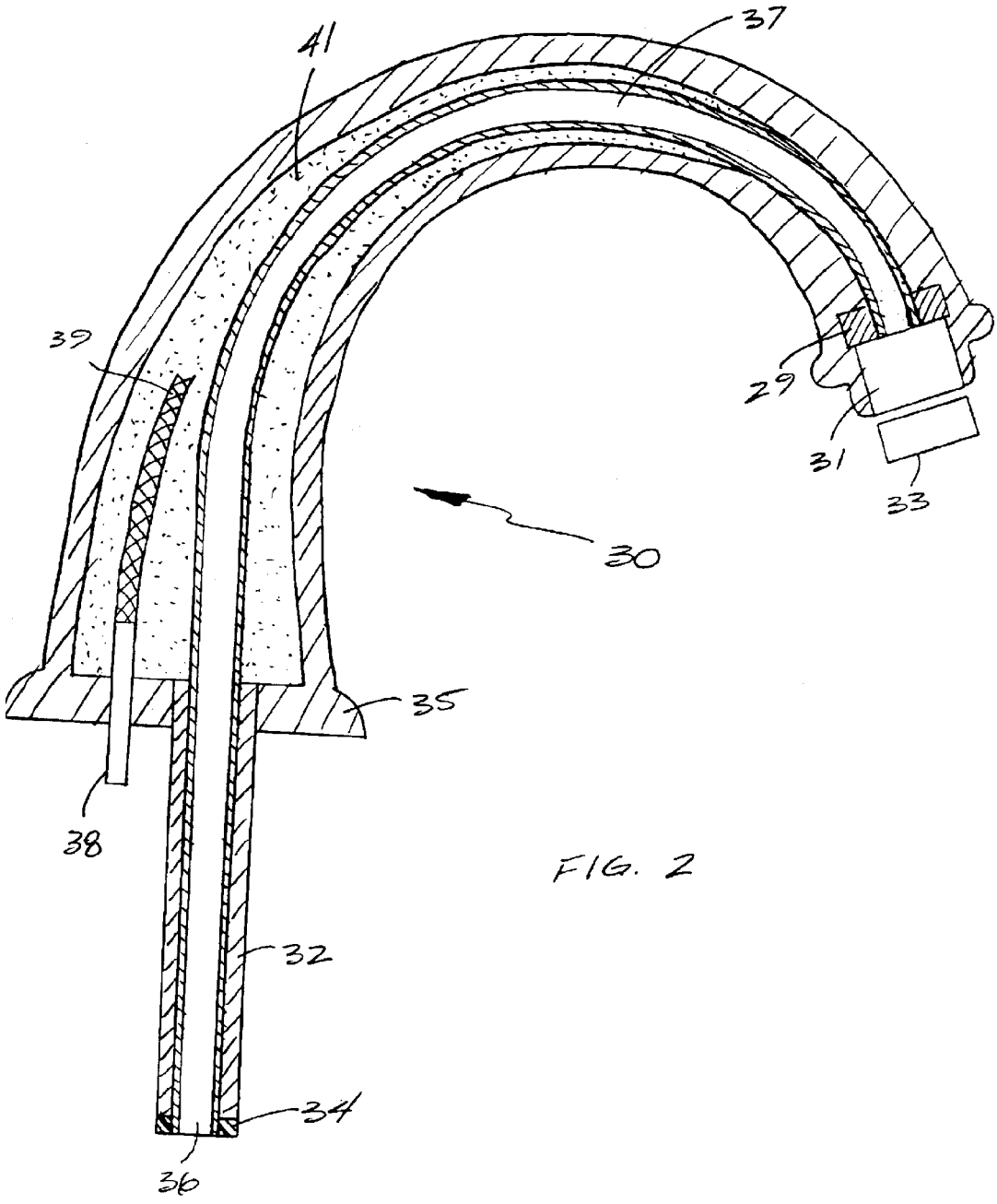
FIG. 2 is a cross-sectional side view of a second embodiment of a water delivery device in accordance with the principles of the present invention.

FIG. 2 illustrates a second embodiment of a water delivery device 30 in the form of a faucet in accordance to the principles of the present invention. This embodiment of a water delivery device 30 is similar to the water deliver device 10 described in FIG. 1. The water delivery device 30, however, provides an inlet end manufactured to allow the device 30 to be deck mounted to a sink, etc. As such, the water delivery device 30 is provided with a threaded brass pipe 32 or other appropriate fitting cast into the casting 35. The stainless steel liner 37 extends through the brass pipe 32. A rubber washer 34 is fitted over the proximal end 36 of the liner 37 to mate with a deck-type mounting fixture. The distal end of the liner 37 is provided with a flange 29 attached to the liner 37 with the distal end 31 of the fixture 30 being counterbored and threaded to receive an aerator 33. As with the fixture 10 of FIG. 1, the fixture 30 is provided with a core vent 39 and associated chimney tube 38 to allow the cases generated from the sand core 41 to vent properly without damaging the casting 35. Also, the liner 37 is not fixedly attached to the brass pipe 32, which serves as an expansion sleeve during the casting process to allow the casting 35 to contract relative to the liner 37 such that the liner 37 does not place any significant stress on the casting 35. Thus, as the length of the liner 37 contracts less than the longitudinal length of the casting 35, the liner 37 will extend through the brass pipe 32 as needed. After casting, while not necessary, the brass pipe can be welded, crimped or otherwise sealed to the liner 37 if desired.

Figure 3:
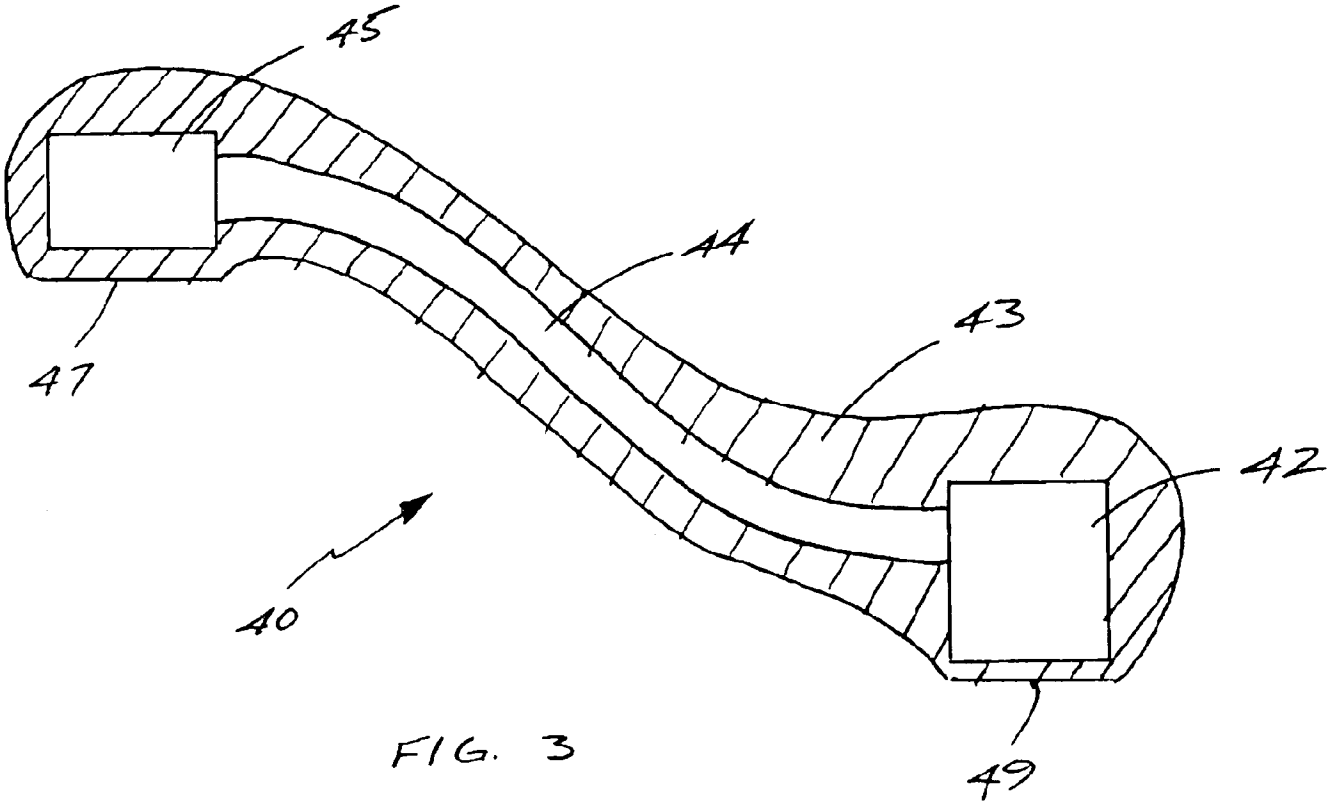
FIG. 3 is a cross-sectional side view of a third embodiment of a water delivery device in accordance with the principles of the present invention.
Figure 4:
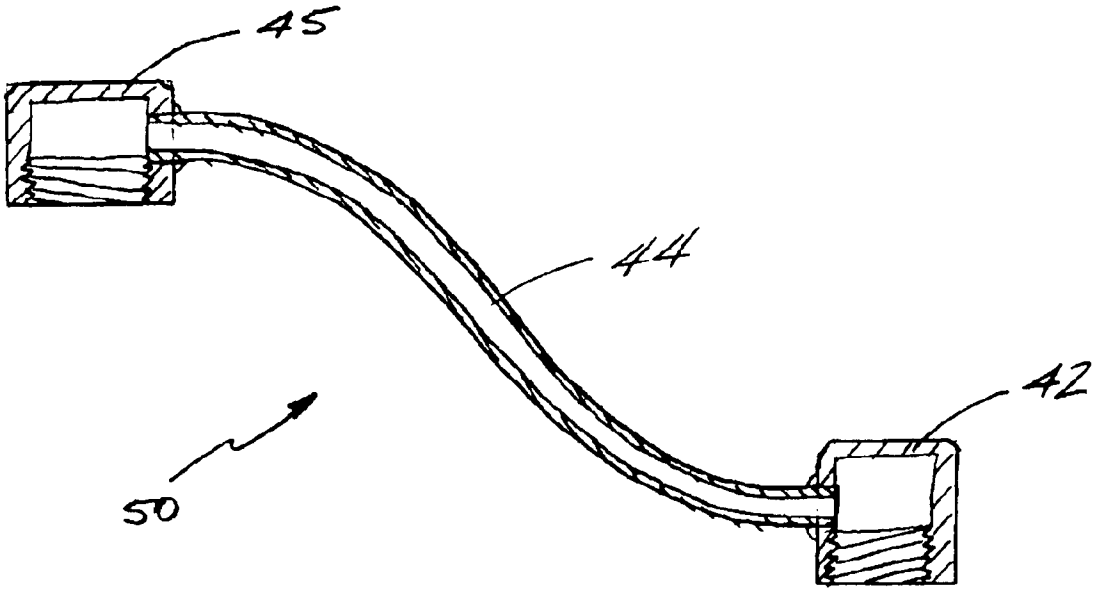
FIG. 4 is a side view of the protective liner shown in FIG. 3.
Figure 5A:
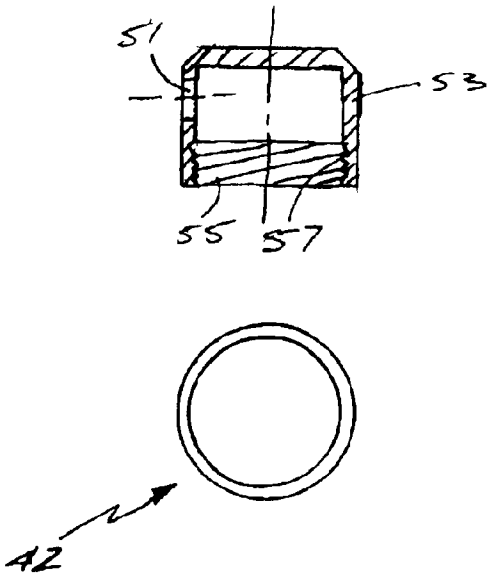
FIGS. 5A and 5B are cross-sectional side views of the fittings shown in FIG. 4.
Figure 5B:
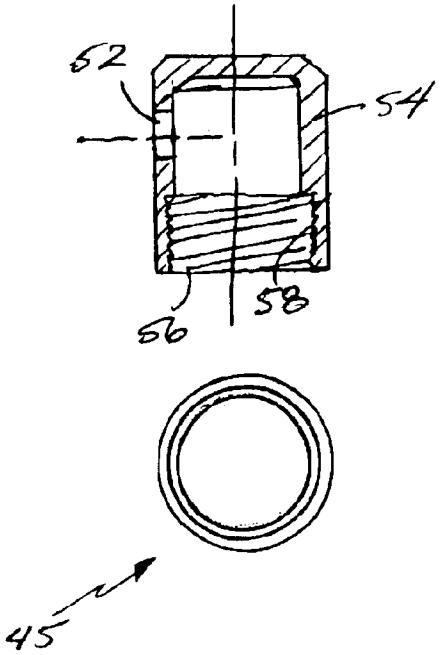

FIG. 3 shows a third embodiment of a water delivery device 40 in accordance with the principles of the present invention. This device 40 has fittings 42 and 45 at the inlet and the outlet of the water delivery device 40, respectively. The fittings 42 and 45, as further illustrated in FIG. 5, allow the water delivery device 40 to attach to an aerator, such as aerator 22 illustrated in FIG. 1, at the outlet 47 of the device 40 and a conventional plumbing fixture on the inlet end 49 of the device 40. The fittings 42 and 45 are attached to the proximal and distal ends, respectively of the protective liner 44. The liner 44 can then be attached as by welded, soldering or the like as shown to each of the fittings 42 and 45 to form a water-tight seal between the liner 44 and the fittings 42 and 45. The fittings 42 and 45 and the liner 44 may then be cast or molded in plastic, ceramic, bronze or other materials of choice as herein described with reference to other embodiments. As further shown in FIG. 4, the fittings 42 and 45 are pre-threaded, with the fitting 42 sized to attach to a conventional externally threaded plumbing fitting and the fitting 45 sized to receive a conventional internally or externally threaded aerator, such as aerator 22 illustrated in FIG. 1. As shown in FIGS. 5A and 5B, the fittings 42 and 45 are provided with transversely extending bores 51 and 52 in their respective side walls 53 and 54. Each open end 55 and 56 is threaded with internal threads 57 and 58 for attachment to other plumbing fixtures known in the art.

Figure 6:
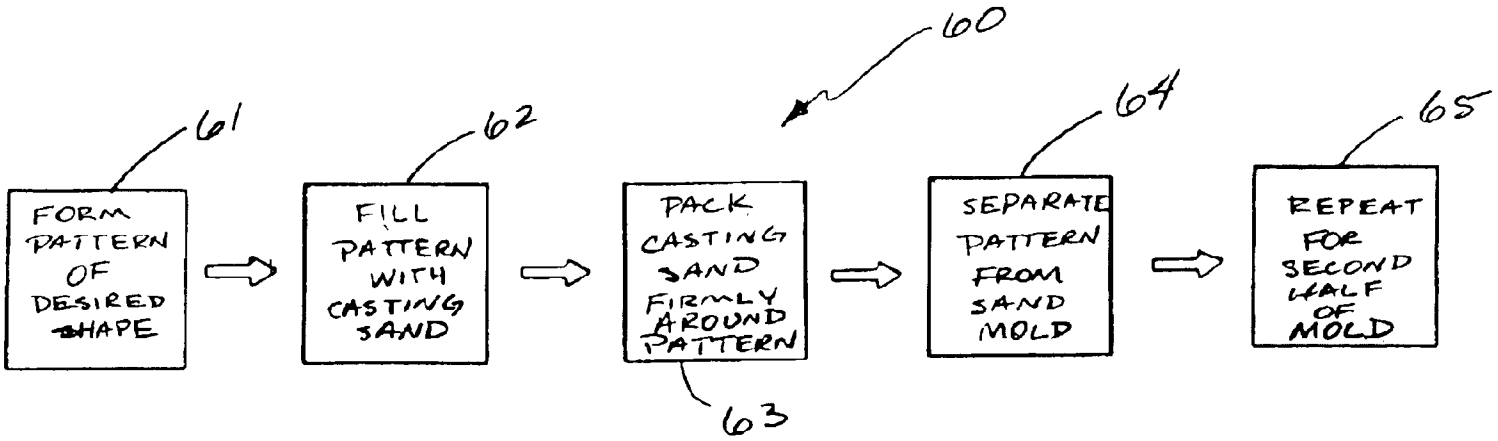
FIG. 6 is a schematic block diagram of a method of manufacturing a mold for forming a water delivery device in accordance with the principles of the present invention.
Figure 7:
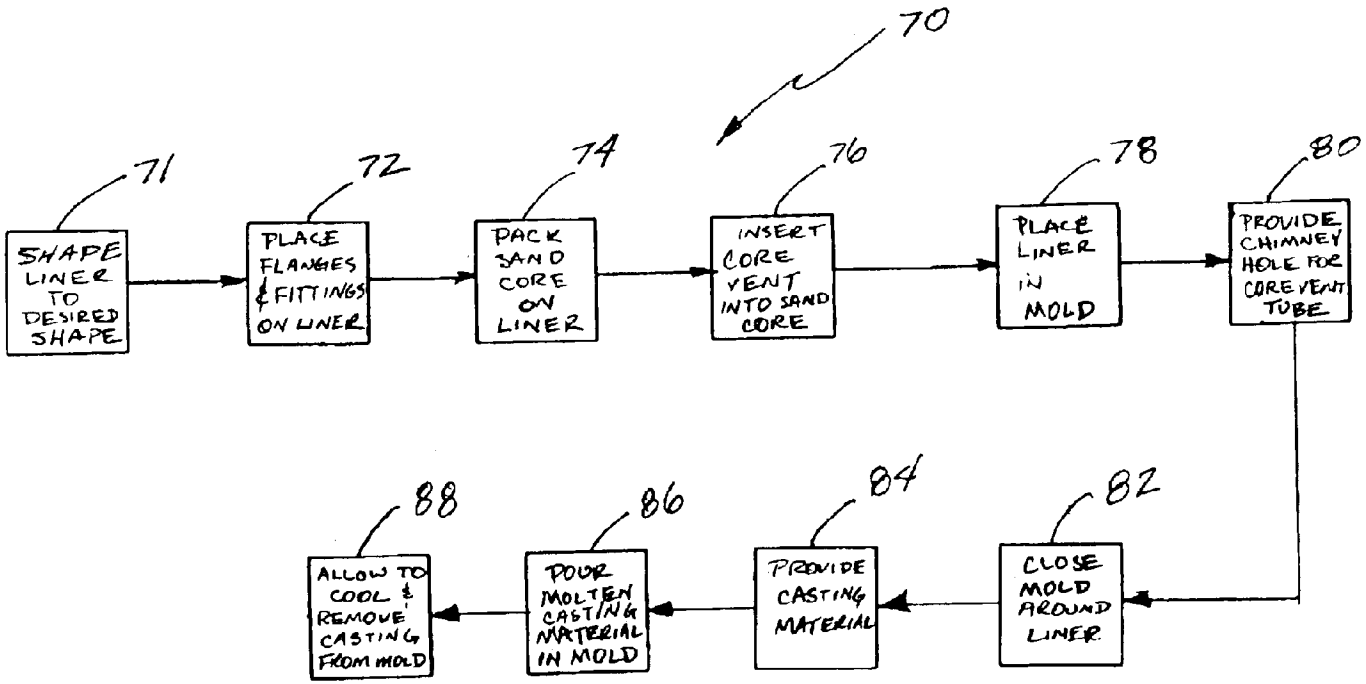
FIG. 7 is a schematic block diagram of a method of casting a water delivery device in accordance with the principles of the present invention.
Figure 8:
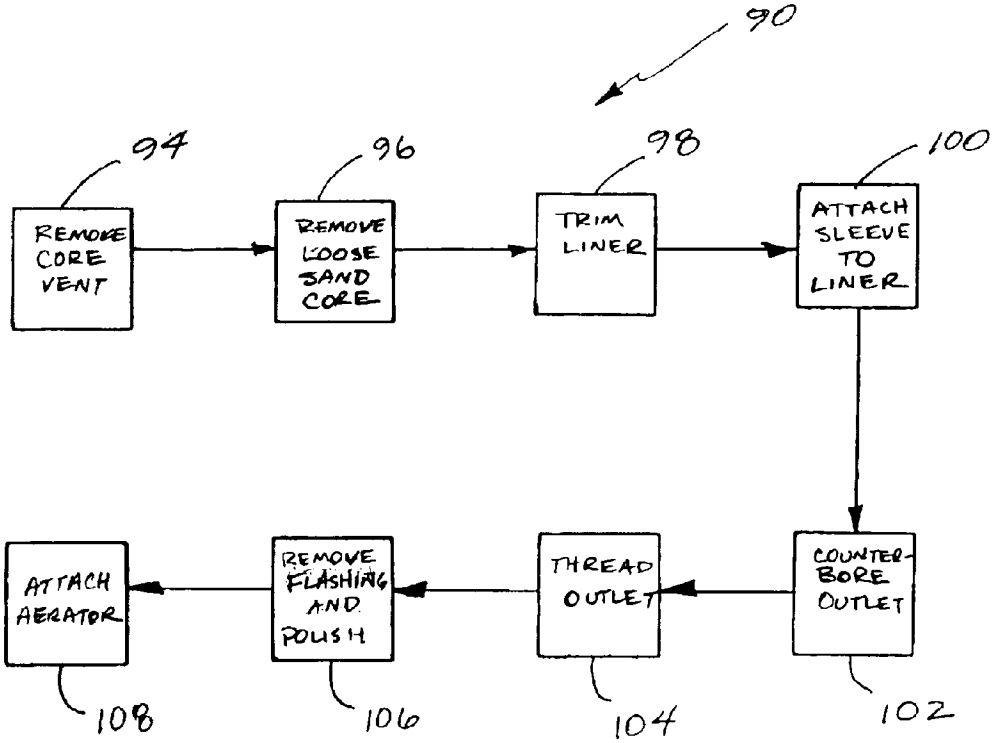
FIG. 8 is a schematic block diagram of a method of finishing a water delivery device in accordance with the principles of the present invention.

FIGS. 6, 7 and 8 are schematic block diagrams illustrating various steps employed in the manufacture of a water delivery device, such as the faucet 10, in accordance with the principles of the present invention. Of course, those of skill in the art will appreciate that various other methods of manufacturing a water delivery device in accordance with the principles of the present invention including, but not limited to, investment casting, permanent mold methods and other molding processes may also be employed. It should also be noted that while the method of the present invention is illustrated as being in a particular order, some of the steps may be performed in various other orders without departing from the spirit and scope of the present invention.

As illustrated in FIG. 6, in order to form the mold that will be used to cast a water delivery, a pattern of the desired shape of the water delivery device 10 a method of mold formation, generally indicated at 60, is performed. The first step is to form 61 a mold pattern of the desired plumbing fixture. The pattern may be formed out of wood, plastic or other moldable or formable materials (see also FIG. 9 which illustrates a completed mold pattern). The pattern is formed in two halves, each mounted within a box-like container for receiving and containing casting sand. The pattern box is filled 62 with casting sand. The casting sand is packed 63 firmly around the pattern of the water delivery device. The pattern is then removed or separated 64 from the sand mold to complete one half of the casting mold with the pattern leaving a hollow in the shape of the water delivery device in the face of the casting sand. The process is then repeated 65 to form the second half of the mold using a pattern having a mirror image of the first to form the opposite half of the desired water delivery device.

Figure 10:
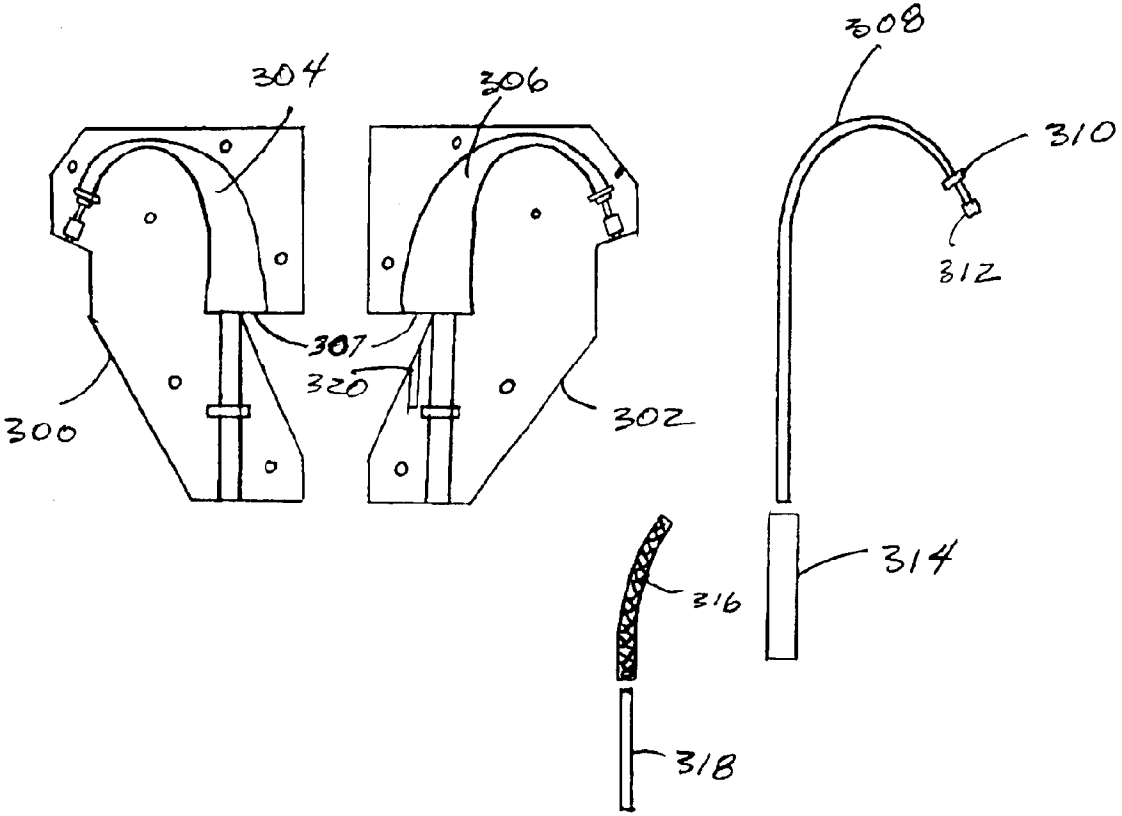
FIG. 10 is a side view of a first embodiment of a core box in accordance with the principles of the present invention and corresponding side views of the liner components for forming a water delivery device in accordance with the principles of the present invention.

As illustrated in FIG. 7, the casting process, generally indicated at 70, is accomplished by bending or otherwise shaping 71 the protective liner into a desire shape or configuration. The liner may be conventionally bent by hand, mandrel or other methods known in the art or hydro formed to produce more complex shapes without crimping, as for example when the liner is formed from stainless steel tubing. After the liner is shaped 71, various flanges and/or fittings are placed 72 on or attached to the liner (see for example FIGS. 10 and 11). The liner is shaped to fit properly within the mold along with the core vent and other liner components as herein described (see FIG. 12). A sand core is then packed 74 around the liner in a shape similar to the inside of the mold cavity while providing for a desired thickness of the casting material between the sand core and the inside surface of the mold cavity (see also FIG. 12). For example, the sand core may leave about a quarter inch annular space between the sand core and the inside surface of the mold cavity. A core vent is inserted 76 into the sand core as it is being formed. If necessary, a support core is provided to support the proximal end of the liner and the core vent tube during casting (see FIG. 12). The liner, at least partially encased with the sand core, is then placed 78 in the mold (see also FIG. 12). The liner extends beyond the primary mold cavity so as to not be encapsulated by the casting material. In addition, a chimney hole is provided 80 in the mold to be in communication with the core vent tube to allow gas to escape through the mold. Of course, for plastic casting or other molding processes, a core vent may not be needed. The mold is then closed 82 by placing the two mold halves together. Molten casting material is provided 84 and poured 86 into the mold. This material can be brass, bronze, ceramic, plastics, etc. The casting is allowed to cool and then removed 88 from the mold (see also FIG. 13).

Once the casting is removed 88 from the mold, as discussed with reference to FIG. 7, the finishing process, generally indicated at 90, in accordance with the principles of the present invention, is performed as illustrated in FIG. 8. Once the casting is removed from the mold, the core vent tube can be removed 94 from the casting as by twisting until loosened. The casting may then shaken to remove 96 the now loose sand particulate material once forming the protective sand core. The loose sand core can be poured from the hole left by the core vent tube. The liner is trimmed 98 to the desired length. The expansion sleeve is attached 100 to the liner as by welded, soldered, crimping or otherwise connecting. The outlet of the water delivery device is counterbored 102 to the flange. This creates an opening with the flange acting as a bottom or abutment surface of the counterbored opening. This drilled opening is then threaded 104 as for receiving an aerator. The external or decorative surface of the device is then finished by removing 106 any flashing that is present on the device at the interface between the two mold halves and then polished to the desired surface finish. An aerator may then be attached 108 to the threaded outlet of the water delivery device.

Figure 9:
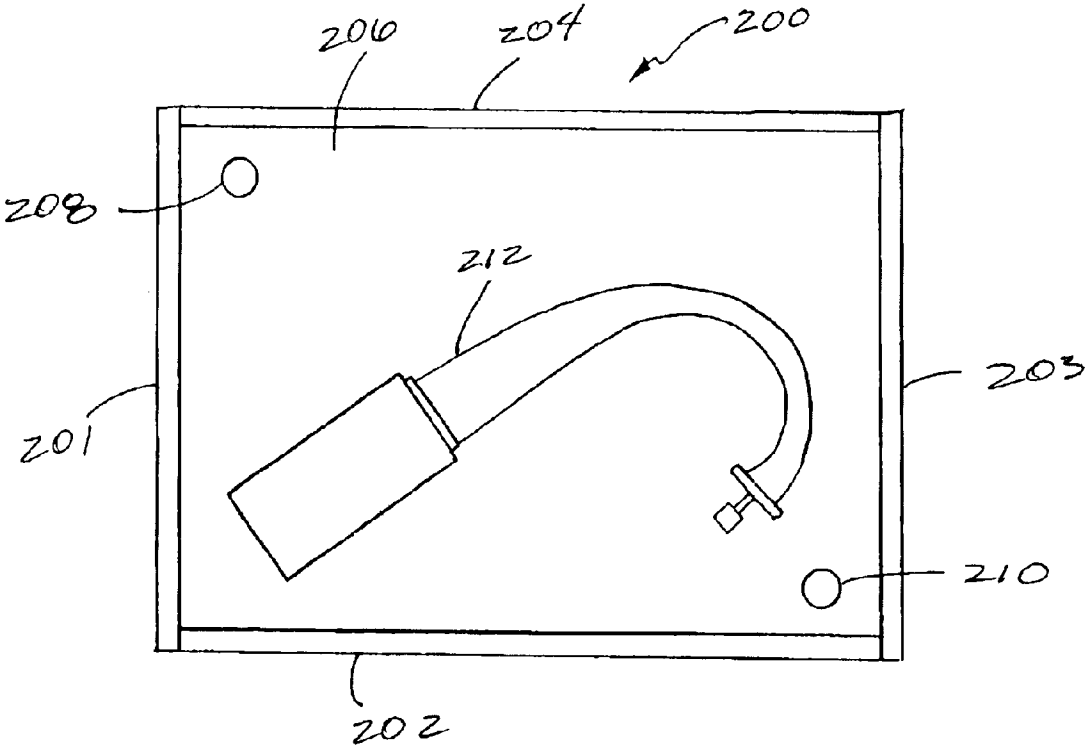
FIG. 9 is a top view of a pattern box used in manufacturing a water delivery device in accordance with the principles of the present invention.

As shown in FIG. 9, a mold pattern box, generally indicated at 200, is illustrated. The box 200 is comprised of a plurality of side walls 201, 202, 203 and 204 and a bottom 206. The depth of the box 200 is such that the sand mold formed therefrom has sufficient thickness to be structurally sound. Mold alignment features 208 and 210, in the form of either holes or protrusions depending upon which mold half is being formed, are provided in or on the box bottom 206. A pattern 212 is also attached to the box bottom 206 at a location that allows sufficient spacing between the pattern 212 and the side walls of the box 200. The pattern 212 effectively forms a relief on the box bottom surface 206. The pattern 212 is one half of the water delivery device with a second mirror image pattern box formed to create the second half of the mold. As previously discussed, the mold pattern 212 may be formed by creating a replica of the desired water delivery device out of wood or other easily moldable or shapable material. The replica is then cut or otherwise separated along its longitudinal length into two matching halves. Each half is then used to form a pattern box as described herein to form each half of the casting mold.

In order to form an appropriately sized core for a given mold, two halves of a core box 300 and 302 are formed to define the sand core cavities 304 and 306, respectively. The stainless steel tubing 308 is shaped to not only fit within the core cavities 304 and 306 and generally match the contour of the core cavities 304 and 306, but to fit substantially along a centerline of the core cavity once the mold halves 300 and 302 are assembled. The core cavities have the same general contour as the mold cavities of the mold, but with a slightly smaller diameter so as to allow for the annular space between the core and the mold cavity for receiving molten metal to form a casting. The flange 310 is placed on the tubing 308 and a centering insert 312 is placed on the distal end of the tubing 308 to hold and center the tubing 308 relative to the mold cavity at the outlet of the device to ensure that the tubing is positioned at the center of the outlet.

The expansion sleeve 314 is then placed over the proximal end of the tubing 308. The core vent 316 and core vent tube 318 are also provided, with the core vent tube 318 to be fitted within a core vent channel 320 and the core vent 316 fitted onto the core vent tube 318 and placed at least partially into the core cavity 306. By closing the two core box halves 300 and 302 together, core sand can be packed into the core cavities 304 and 306 through the opening 307 formed by the two halves 300 and 302 when closed.

Figure 11:
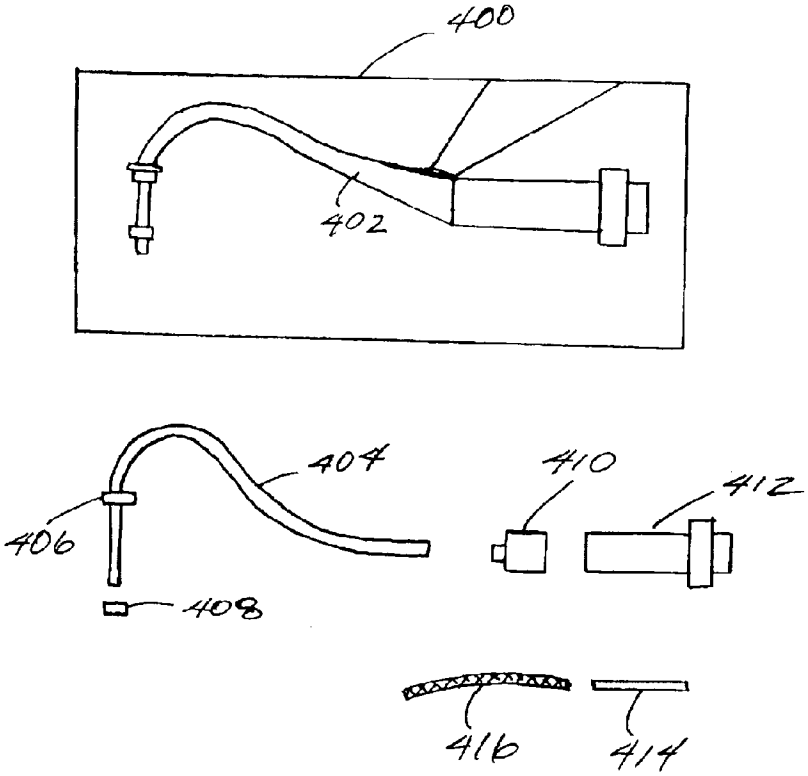
FIG. 11 is a side view of a second embodiment of a core box with the corresponding liner components for insertion into the core box in accordance with the principles of the present invention.

FIG. 11 illustrates another configuration of a core half and associated liner parts for forming a water delivery device in accordance with the principles of the present invention. The core half 400 defines a core cavity 402 for receiving the stainless steel tubing liner 404. Similar to that described with reference to FIG. 10, the liner 404 is provided with various flanges 406, liner centering devices 408 and 412 and expansion sleeve 410. A core vent tube 414 and core vent material 416 are also provided to be inserted into the core half 400. A mirror image of the core half 400 is provided to complete the core box. As such, the liner 404 and associated parts can be assembled and held with core sand. The completed core is then placed in a mold cavity in accordance with the principles of the present invention for the casting process.

Figure 12:
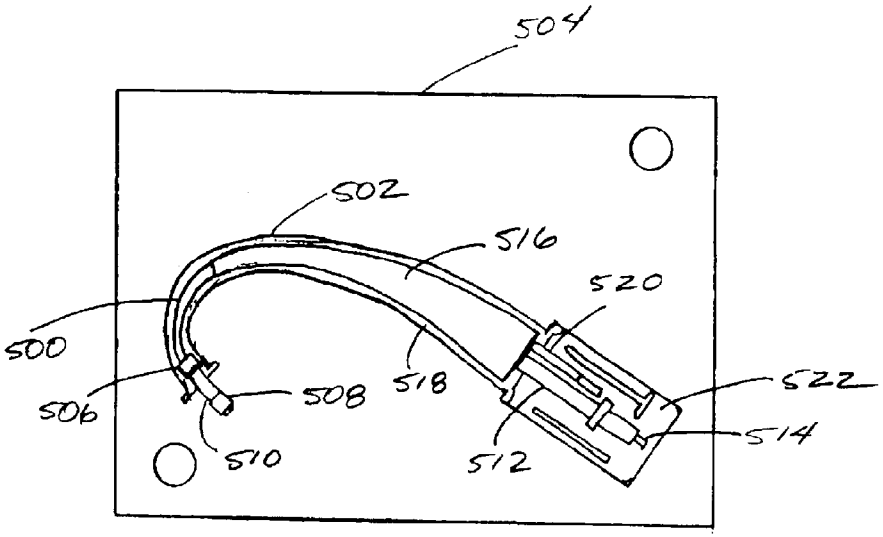
FIG. 12 is a side view of a third embodiment of a mold half with the liner components and core vent positioned within the mold cavity with a portion of the liner components encased in a mold core material in accordance with the principles of the present invention.

As shown in FIG. 12, various components and material are attached to the stainless steel tubing liner 500 prior to insertion into the mold cavity 502 of the mold half 504. For example, a flange 506 and liner centering sleeve 508 are attached to the distal end 510 of the liner 500. An expansion sleeve 512 is placed on the distal end 514 of the liner 500. As described with reference to FIGS. 10 and 11, a protective sand core 516 is formed over at least a portion of the liner 400 along a length thereof at the wider portions of the mold cavity 502. The diameter of the sand core 516 varies along the length of the liner 500 so as to provide a relatively consistent annular space 518 between the outer surface of the sand core 516 and the inside surface of the mold cavity 502. This provides a relatively uniform thickness of the casting along the length of the liner 500. A core vent 520 is inserted into the sand core 516 to allow the venting of gas generated by the sand core 516 during the casting process. Core sand may also be inserted and packed into the inside of the liner 400 to further absorb heat during casting and draw the heat away from the liner 400. A support core 522, comprised of casting sand, may also be provided to support the sleeve 512 and core vent 520 during the casting process. A mirror image of the support core 522 would be provided in the second half of the mold 504. Once assembled with the second mold half (not shown), the mold cavity 502 is then filled with molten casting material to form the desired water deliver device of the present invention.

Figure 14:
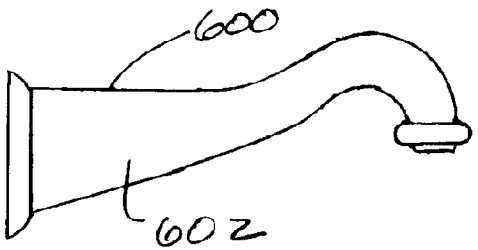
FIG. 14 is a side view of a post castings of a water delivery device in a finished state in accordance with the principles of the present invention.
Figure 13:
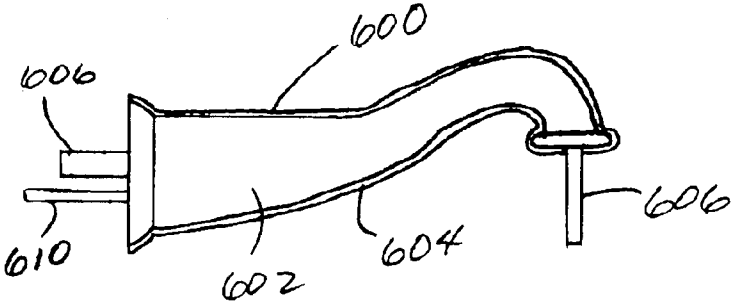
FIG. 13 is a side view of a post castings of a water delivery device in accordance with the principles of the present invention.

As shown in FIG. 13, once a casting 600 is removed from the mold, the outer surface 602 of the casting 600 is relatively rough and flashing 604 extends around the part due to the flow of casting material between the mold halves during the casting process. Moreover, the liner 606 will extend from both ends of the casting 600. In order to produce the finished plumbing part 600 of FIG. 14, the flashing 604 must be removed, and the tubing 606 trimmed or otherwise machined from protruding out of the part 600 as herein described. In addition, the core vent tube 610 is removed and the core sand may be removed from the inside of the casting 600 through the hole left by the core vent tube 610. Finally, the outside surface 602 of the part 600 can be polished to the desired surface finish.

Figure 15:
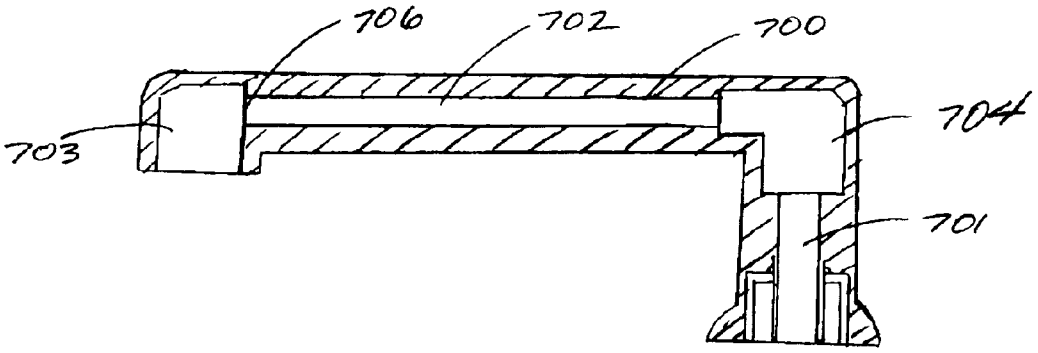
FIG. 15 is a cross-sectional side view of a fourth embodiment of a water delivery device in accordance with the principles of the present invention.

It is also contemplated as illustrated in FIG. 15, that plumbing parts in accordance with the principles of the present invention may be formed into more complex shapes than may be accomplished by simple bending of the liner. As such, the liner 700 may be formed from both one or more sections of stainless steel tubing 701 and 702 as well as various forged, pre-cast or machined fittings and coupling devices 703 and 704, with the joints, such as joint 706 coupling the tubing to the fittings by welding, soldering, crimping or other methods known in the art. As such, a combination of tubing sections as well as preformed fittings or coupling devices may be employed where sharp bends or complex shapes would make stainless steel tubing difficult if not impossible to employ. Such fittings and coupling devices could be employed at either end of the water delivery device or at any point along its length.

It should be understood that reference herein to specific details of the illustrated embodiments is by way of example and not by way of limitation. For example, while the present invention has been described with specific reference to metal liner components and metal casting materials, it is also contemplated that various plastics, ceramics or other moldable or castable materials may be utilized with any liner material approved for potable water in accordance with the principles of the present invention. It will be apparent to those skilled in the art that many additions to, deletions of, modifications to and combinations of the illustrated embodiments of the invention may be made without departing from the spirit and scope of the invention as defined by the following claims.

What is claimed is:

1. A water delivery apparatus, comprising:

an exterior casting formed from molten metal having an inlet at a proximal end and an outlet at a distal end;

an interior liner extending from proximate said proximal end to proximate said distal end; and a sleeve attached to said proximal end of said casting and placed at least partially over said interior liner proximate said proximal end, said sleeve allowing contraction of said casting relative to said liner during the casting process.

2. The apparatus of claim 1, wherein said liner is comprised of at least one segment of tubing comprised of at least one of stainless steel, copper and any material that meets the NSF requirements for clean drinking water.

3. The apparatus of claim 2, wherein said liner is comprised of at least one fitting attached to an end of said at least one segment of tubing.

4. The apparatus of claim 2, wherein said sleeve extends over a portion of said tubing proximate said proximal end of said casting.

5. The apparatus of claim 4, wherein said sleeve and said tubing are attached to form a water-tight seal therein between.

6. The apparatus of claim 1, wherein said liner and said casting form an annular space therein between along at least a portion of said liner.

7. The apparatus of claim 1, wherein said outlet of said casting is provided with threads for coupling an aerator thereto and a fitting attached at said inlet for attachment to a conventional plumbing fitting.

8. The apparatus of claim 1, wherein said liner is comprised of at least two lengths of tubing and at least one coupling device for interconnecting the at least two lengths.

9. The apparatus of claim 1, having a flange coupled to said liner at a distal end thereof, and a fining attached to said sleeve at a proximal end of said liner.

10. A water delivery apparatus, comprising:

an exterior casting formed from molten metal having an inlet at a proximal end and an outlet at a distal end;

at least one segment of stainless steel tubing forming a waterway within said casting; and an expansion sleeve attached to said proximal end of said casting and placed at least partially over said at least one segment proximate said inlet, said expansion sleeve allowing contraction of said casting relative to said tubing during the casting process.

11. The apparatus of claim 10, further including at least one fitting attached to an end of said at least one segment of stainless steel tubing.

12. The apparatus of claim 10, wherein said sleeve extends over a portion of said tubing proximate said proximal end of said casting.

13. The apparatus of claim 12, wherein said sleeve and said tubing are attached to form a water-tight seal therein between.

14. The apparatus of claim 10, wherein said tubing and said casting form an annular space therein between along at least a portion of said tubing.

15. The apparatus of claim 10, wherein said outlet of said casting is provided with threads for coupling on aerator thereto and a fitting attached at said inlet for attachment to a conventional plumbing fitting.

16. The apparatus of claim 10, wherein said at least one segment is comprised of at least two lengths of tubing and at least one coupling device for interconnecting the at least two lengths.

17. The apparatus of claim 10, having a flange coupled to said tubing at a distal end thereof, and a fitting attached to said sleeve at a proximal end of said tubing, said fitting configured for attaching to a conventional plumbing fitting.

18. A water delivery apparatus, comprising:

an exterior casting having an inlet at a proximal end and an outlet at a distal end;

an interior liner extending from proximate said proximal end to proximate said distal end, said liner and said casting forming an annular space therein between along at least a portion of said liner; and a sleeve attached to said proximal end of said casting and placed at least partially over said interior liner proximate said proximal end, said sleeve allowing contraction of said casting relative to said liner during the casting process.

19. The apparatus of claim 18, wherein said exterior casting is formed from molten metal.

20. The apparatus of claim 18, wherein said liner is comprised of at least one segment of tubing comprised of at least one of stainless steel, copper and any material that meets the NSF requirements for clean drinking water.

21. The apparatus of claim 20, wherein said liner is comprised of at least one fitting attached to an end of said at least one segment of tubing.

22. The apparatus of claim 20, wherein said sleeve extends over a portion of said tubing proximate said proximal end of said casting.

23. The apparatus of claim 22, wherein said sleeve and said tubing are attached to form a water-tight seal therein between.

24. The apparatus of claim 18, wherein said outlet of said casting is provided with threads for coupling an aerator thereto and a fitting attached at said inlet for attachment to a conventional plumbing fitting.

25. The apparatus of claim 18, wherein said liner is comprised of at least two lengths of tubing and at least one coupling device for interconnecting the at least two lengths.

26. The apparatus of claim 18, having a flange coupled to said liner at a distal end thereof, and a fitting attached to said sleeve at a proximal end of said liner.

27. A water delivery apparatus, comprising:

an exterior casting having an inlet at a proximal end and an outlet at a distal end;

at least one segment of stainless steel tubing forming a waterway within said casting; and an expansion sleeve attached to said proximal end of said casting and placed at least partially over said at least one segment proximate said inlet, said expansion sleeve allowing contraction of said casting relative to said liner during the casting process, said at tubing and said casting forming an annular space therein between along at least a portion of said tubing.

28. The apparatus of claim 27, wherein said exterior casting is formed from molten metal.

29. The apparatus of claim 27, further including at least one fitting attached to an end of said at least one segment of stainless steel tubing.

30. The apparatus of claim 27, wherein said sleeve extends over a portion of said tubing proximate said proximal end of said casting.

31. The apparatus of claim 30, wherein said sleeve and said tubing are attached to form a water-tight seal therein between.

32. The apparatus of claim 27, wherein said outlet of said casting is provided with threads for coupling an aerator thereto and a fitting attached at said inlet for attachment to a conventional plumbing fitting.

33. The apparatus of claim 27, wherein said at least one segment is comprised of at least two lengths of tubing and at least one coupling device for interconnecting the at least two lengths.

34. The apparatus of claim 27, having a flange coupled to said tubing at a distal end thereof, and a fitting attached to said sleeve at a proximal end of said tubing, said fitting configured for attaching to a conventional plumbing fitting.

* * * * *